United States Patent [19]

Fort

[11] Patent Number: 4,824,095

[45] Date of Patent: Apr. 25, 1989

[54] DEVICE FOR POSITIONING A THIN OBJECT OF LOW STIFFNESS

[75] Inventor: Jacques Fort, Darnieulles, France

[73] Assignee: Society les Applications Industrielles Vosgiennes en Abrégé , Darnieulles, France

[21] Appl. No.: 628,988

[22] Filed: Jul. 9, 1984

[30] Foreign Application Priority Data

Jul. 8, 1983 [FR] France ..... 83 11388

[51] Int. Cl.[4] ..... B65H 9/04

[52] U.S. Cl. ..... 271/245; 271/250; 271/252; 198/750

[58] Field of Search ..... 271/245, 22 B, 267, 271/241, 250, 252, 248, 249, 229, 230, 231, 189; 198/750, 486, 434

[56] References Cited

U.S. PATENT DOCUMENTS

| | | | |
|---|---|---|---|
| 1,290,390 | 1/1919 | Spiess | 271/252 |
| 2,087,997 | 7/1937 | Reinartz | 271/231 |
| 3,713,647 | 1/1973 | Tamura et al. | 271/250 X |
| 3,860,230 | 1/1985 | Georges | 271/267 X |
| 4,260,149 | 4/1981 | Melzer | 271/250 X |

FOREIGN PATENT DOCUMENTS

| | | | |
|---|---|---|---|
| 3002594 | 8/1980 | Fed. Rep. of Germany . | |
| 2348878 | 11/1977 | France . | |
| 2413941 | 8/1979 | France . | |
| 2100210 | 12/1982 | United Kingdom | 198/750 |

*Primary Examiner*—Andres Kashnikow
*Assistant Examiner*—M. C. Graham
*Attorney, Agent, or Firm*—Fisher, Christen & Sabol

[57] ABSTRACT

The device comprises a conveyor (A) driven with a reciprocating movement by means of a jack (V1) and on which the object (T) is placed in any way, wherein a stationary stop (CO), located crosswise with respect to said movement, acts as a deviating means as the object comes into contact with it. The device is completed with a vertically movable parts (BP), which almost comes into flush relationship with the upper part of the object so as to abviate any distortion in the plane (FIG. 3).

3 Claims, 2 Drawing Sheets

DEVICE FOR POSITIONING A THIN OBJECT OF LOW STIFFNESS

BACKGROUND OF THE INVENTION

1. Field of the Invention

The present invention relates to a device for positioning a sheet of paper, a piece of fabric or a similar matter so as to give same a predetermined orientation, whatever the orientation it initially may have.

2. The Prior Art

It is well known, in some handling devices, to change the moving path of an object by driving it in a given direction to a deviation stop.

For instance it is the case in FR-A-No. 2 413 941, in which stationary blocks cause an object to pursure its run according to a slant direction with respect to the driving direction.

The present invention makes use of an analogous principle not to change the moving path, but to orientate the object.

Otherwise, printing machines comprise before the printing mechanisms a feed table (for instance DE-A-No. 3 002 594 U.S. Pat. No. 2,087,997; FR-A-No. 2 348 878) provided for strictly aligning sheets of paper. Said tables are supplied with a vacuum means which does not permit a swivelling movement of the sheets moving on its way.

SUMMARY OF THE INVENTION

An object of the present invention is to provide a turning device in which a rectilinear stop is located across a reciprocating conveyor moving the object to be positioned.

Other particularities and advantages will become apparent from the following description with reference to attached drawings.

— THE DRAWINGS

DESCRIPTION OF THE PREFERRED EMBODIMENT

As is obvious on the figures, the device comprises a frame BA shown with its top table and to which an angle iron is rigidly fixed, said angle iron supporting a bracket CS and the body of the jack V1.

On said top table, a plate A can execute a reciprocating movement, a folded part A1 of the plate being integral with the rod EP of the jack V1.

That plate A slides in a slot CF provided between the upper face of BA and the lower face of the angle iron CO. The bracket CS bears a jack V2, piston rod DP of which is integral with a plate BP.

That plate BP is height adjustable so that, in the most extended position of the jack V2, the lower part of the plate almost is flush with the upper part of the object to be positioned so as to maintain same plane.

Working of said device is as follows.

Figure 1:
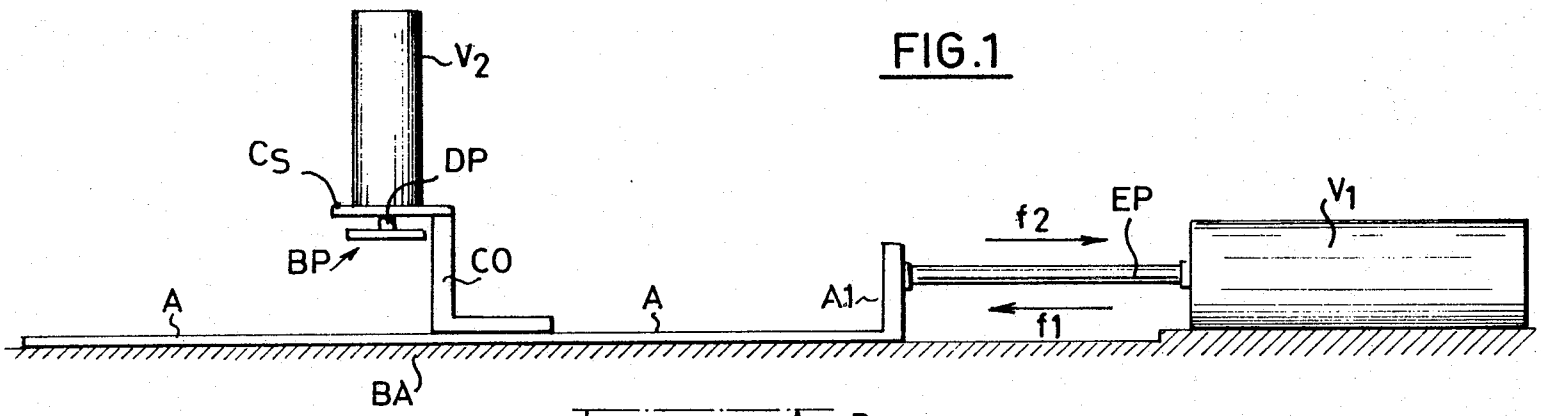
FIG. 1 is an elevation view of the device.
Figure 2:
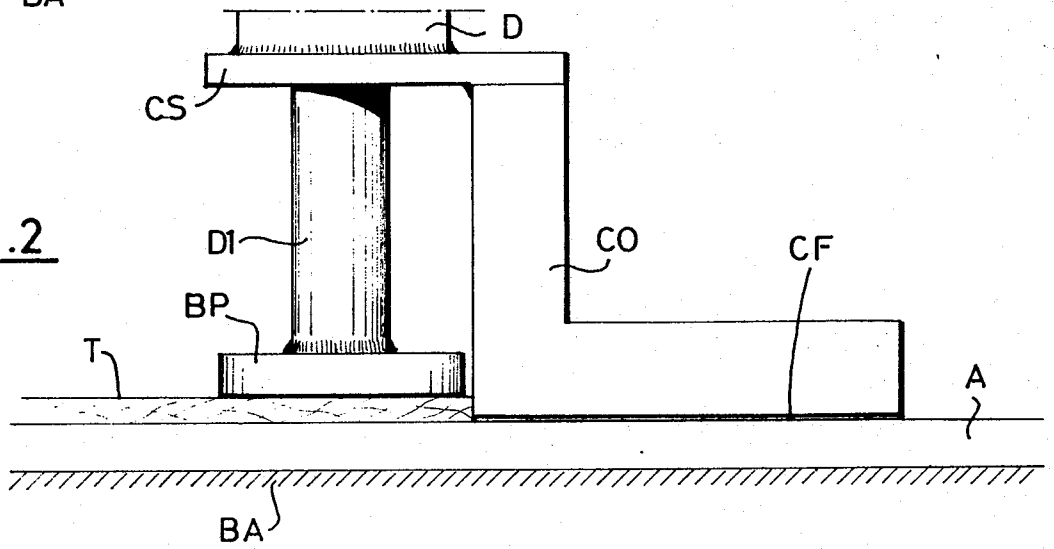
FIG. 2 is a partial view.
Figure 3:
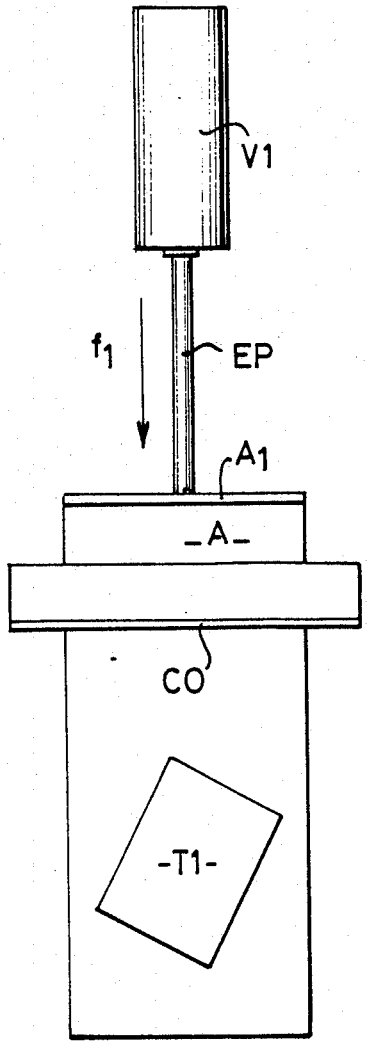
FIGS. 3 and 4 are schematic views showing the object in being oriented.

Plate A, which forms a shovel, is brought into the position as appears on FIG. 3, through extension of the jack 1 according to arrow f1.

The object T1 is put on said plate in front of the angle iron CO; its weight is sufficient to make it adhering to that plate.

The jack V1 retracts slowly according to f2. The jack V2 extends and drives the plate BP in lowering same till the plate almost become flush with the upper part of the object to be positioned, so as to maintain said object as plane as possible.

Figure 4:
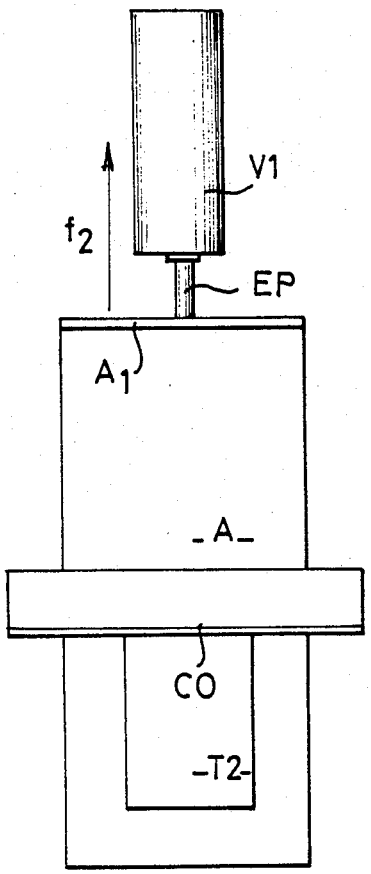

During the continued retraction of the jack V1, the object engages the angle iron CO and turns to take the position T2 (FIG. 4) with one of its edges or at least two points coming into contact with the front face of the angle iron.

The device according to the invention finds applications particularly in the field of confection shops as part of a robot or of a mechanized chain.

What is claimed is:

1. A device, including a frame and a stop, for positioning an object of small thickness and of low stiffness as a sheet of paper or a price of fabric against said stop, said object being moved with said device until a portion of said object abuts said stop and said object being further moved once the friction giving it sufficient adherence to the device is overcome, and permitting that movement by means of a reciprocating conveyor, characterized in that said reciprocating conveyor is shovel-like (A), that said shovel-like reciprocating conveyor has sufficient dimensions in both the longitudinal and transverse directions to fully accommodate and support said object to be positioned during the entire stroke of the reciprocating conveyor, that said stop includes a rectilinear stationary angle iron (CO) located crosswise with respect to the movement of the shovel, and that the shovel (A) slides in a slot (CF) provided between the upper face of the top table of the frame (BA) and the lower face of the angle iron—stop (CO), under the action of a double acting jack (V1).

2. Device according to claim 1 comprising means to avoid horizontal distortion of said sheet or piece, characterized in that said means are comprised of a movable plate (BP) which is able to vertically slide.

3. Device according to claim 2 characterized in that said plate is integral with the piston of a vertical jack (V2).

* * * * *